US005840214A

United States Patent [19]

Kinlen

[11] Patent Number: 5,840,214

[45] Date of Patent: Nov. 24, 1998

[54] METHOD OF INCREASING POLYANILINE CONDUCTIVITY WITH IONIC SURFACTANTS

[75] Inventor: Patrick J. Kinlen, Fenton, Mo.

[73] Assignee: Monsanto Company, St. Louis, Mo.

[21] Appl. No.: 690,213

[22] Filed: Jul. 26, 1996

[51] Int. Cl.[6] ..... H01B 1/12; B05D 3/10

[52] U.S. Cl. ..... 252/500; 427/337

[58] Field of Search ..... 252/500; 528/422, 528/433, 210; 427/337

[56] References Cited

U.S. PATENT DOCUMENTS

| | | | |
|---|---|---|---|
| 5,217,649 | 6/1993 | Kulkarni et al. | 252/500 |
| 5,232,631 | 8/1993 | Cao et al. | 252/500 |
| 5,281,363 | 1/1994 | Shacklette et al. | 252/500 |
| 5,403,913 | 4/1995 | MacDiarmid et al. | 528/495 |
| 5,520,852 | 5/1996 | Ikkala et al. | 252/521 |
| 5,589,108 | 12/1996 | Shimizu et al. | 252/500 |
| 5,595,689 | 1/1997 | Kulkami et al. | 252/500 |
| 5,720,903 | 2/1998 | Wessling et al. | 252/500 |

FOREIGN PATENT DOCUMENTS

| | | |
|---|---|---|
| 0 497 514 A1 | 8/1992 | European Pat. Off. . |
| 2240139 | 9/1990 | Japan . |
| 2282245 | 11/1990 | Japan . |
| 8120167 | 5/1996 | Japan . |
| 8325452 | 12/1996 | Japan . |
| WO 95/34080 | 12/1995 | WIPO . |

OTHER PUBLICATIONS

"Polyaniline: Conformational Changes Induced in Solution by Variation of Solvent and Doping Level" by Jamshid K. Avlyanov, et al., *Snythetic Metals*, vol. No. 72 (1995) pp. 65–71. (No Month).

"Secondary Doping in Polyaniline" by Alan G. MacDiarmid and Arthur J. Epstein, *Synthetic Metals*, vol. No. 69, (1995), pp. 85–92. (No Month).

"A method to Prepare Soluble Polyaniline Salt Solutions—in situ Doping of PANI Base with Organic Dopants in Polar Solvents" by K. Tzou and R.V. Gregory, *Synthetic Metals*, vol. No. 53 (1993), pp.365–377. (No Month).

"Morphology of Conductive, Solution–Processed Blends of Polyaniline and Poly(Methyl Methacrylate)" by C.Y. Yang, et al., *Synthetic Metals*, vol. No. 53, (1993), pp. 293–301. (No Month).

"Emulsion Polymerization of Aniline" by J.E. Österholm, et al., *Synthetic Metals*, vol. No. 55–57, (1993), pp. 1034–1039. (No Month).

"Counter–Ion Induced Processibility of Conducting Polyaniline and of Conducting Polyblends of Polyaniline in Bulk Polymers" by Yong Cao, Paul Smith and Alan J. Heeger, *Synthetic Metals*, vol. No. 48 (1992), pp. 91–97. (No Month).

*Primary Examiner*—Mark Kopec

*Attorney, Agent, or Firm*—Howell & Haferkamp, L.C.

[57] ABSTRACT

A method for increasing the conductivity of polyaniline is disclosed. The method comprises contacting the polyaniline with an ionic surfactant whereupon the conductivity of the polyaniline is increased by a factor of at least about 2. Also provided are coating compositions which can be prepared by the method.

19 Claims, 4 Drawing Sheets

METHOD OF INCREASING POLYANILINE CONDUCTIVITY WITH IONIC SURFACTANTS

BACKGROUND OF THE INVENTION (1) Field of the Invention

The present invention relates to processible, electrically conductive polyaniline, and more particularly to methods for increasing the conductivity of polyaniline by contacting the polyaniline with an ionic surfactant.

(2) Description of the Prior Art

Polyaniline is recognized as being chemically stable and electrically conductive in the protonated form. Nevertheless, use of polyaniline has been limited because it has been considered intractable or unprocessible. Recently, methods for preparation of conductive forms of polyaniline have been reported. These involve the production of the polyaniline salt by doping the polyaniline to the protonated, conducting form with acids as well as the synthesis of conducting polyaniline salts of protonic acids. (see, for example, Tzou and Gregory, *Synth Met* 53:365-77, 1993; Cao et al., *Synth Met* 48:91–97, 1992; Osterholm et al., *Synth Met* 55:1034–9, 1993 which are incorporated by reference). The protonic acid serves as a primary dopant providing the counter ion for the protonated emeraldine base form of the polyaniline. Some such protonic acid primary dopants are described as acting as surfactants in that they are purportedly compatible with organic solvents and enable intimate mixing of the polyaniline in bulk polymers (Cao et al, *Synth Met* 48:91–97, 1992; Cao et al, U.S. Pat. No. 5,232,631, 1993 which are incorporated by reference). Thus, any surfactant aspect of the primary dopants was thought to contribute to the processibility rather than the conductivity of the polyaniline and this group did not disclose the further treatment of the doped polyaniline salt with a surfactant to increase conductivity. Furthermore, this group taught the use of protonic acid dopants that were proton donors and not the use of the deprotonated anionic or charged form of the dopant. Moreover, there was no disclosure of the use of a surfactant for increasing the conductivity of processed forms of polyaniline such as films, coatings, fibers and the like.

In copending applications No. 08/335,143 now issued as U.S. Pat. No. 5,567,356, and now issued as U.S. Pat. No. 5,567,356, and 08/596,202 which are incorporated herein by reference, a new emulsion-polymerization process was described for the production of a processible, conductive polyaniline salt which is soluble in carrier solvents such as xylene at a concentration greater than 25%. Although polyaniline salts made by this process can exhibit high conductivity and low resistance in compressed powder pellets, nevertheless, the resistance of films prepared from this material can still be high (see, for instance, examples 16 and 18 in copending application No. 08/335,143). It would thus be desirable to devise a method for increasing the conductivity of this and other processible polyaniline compositions either during the processing or after it has been processed into any of a variety of useful shaped articles such as fibers, films and the like.

One approach that has been described for increasing conductivity of polyaniline has utilized a phenolic compound characterized as a secondary dopant (MacDiarmid et al., U.S. Pat. No. 5,403,913, 1995). By this method, a polyaniline doped with a protonic acid primary dopant is contacted with the phenolic compound and conductivity is reported to increase by a factor of up to about 500–1000 fold. The secondary dopant is thought to produce a conformational change in the polyaniline from a compact coil to an expanded coil form that persists after removal of the secondary dopant. (MacDiarmid and Epstein, *Synth Met* 69:85–92, 1995 which is incorporated by reference). In addition to increasing conductivity, the secondary dopant treatment caused a change from a chloroform-soluble to chloroforminsoluble polyaniline film; a swelling of the treated film that becomes more flexible upon evaporating the secondary dopant; a decrease in viscosity of the polyaniline in the phenolic doping solvent compared to that in chloroform; and a characteristic change in the U.V. absorption spectrum. (MacDiarmid et al., U.S. Pat. No. 5,403,913, 1995; Avlyanov et al., *Synth Met* 72:65–71, 1995; MacDiarmid and Epstein, *Synth Met* 69:85–92, 1995 which are incorporated by reference). Some of these changes might not be desirable. For example, the decrease in chloroform solubility is likely to decrease the processibility of the polyaniline if it is not already in its final form. Furthermore, the reported change in physical properties, i.e. swelling and change in flexibility might not be desirable in applications where a hard protective surface is desired. Moreover, the resultant increase in conductivity depends upon the particular combinations of primary and secondary dopants used such that some combinations may be less effective than others in increasing conductivity (MacDiarmid and Epstein, *Synth Met* 69:85–92, 1995 which are incorporated by reference).

In a variation of this method, it has been reported that a conductive, solution-processed polyblend of poly (methylmethacrylate) (PMMA) and polyaniline-camphor sulfonic acid complex can be prepared using m-cresol as solvent (Yang et al., *Synth Met* 53:293 1993 which is incorporated by reference). In the study of this preparation, the PMMA was dissolved leaving a polyaniline-camphor sulfonic acid complex which was noted to have a conductive, "foam-like" network structure. Nevertheless, this film was insoluble in chloroform and presumably retained the disadvantageous aspects of the material treated with phenolic compounds as secondary dopants.

Thus, there remains a continuing need for methods of preparing highly conductive forms of polyaniline salts of different protonic acid and for methods that do not cause undesirable changes in the properties of the polyaniline or in the ability to further process the polyaniline.

SUMMARY OF THE INVENTION

Briefly, therefore, the present invention is directed to a novel method for the production of a form of polyaniline that has a surprisingly high conductivity. Increases in the conductivity of the polyaniline are to the order of at least about two fold. The process comprises contacting the polyaniline with an ionic surfactant. Ionic surfactants suitable for use in this invention can be cationic surfactants such as, for example, a quaternary ammonium ion or anionic surfactants such as, for example, diphenyl oxide disulfonates or amphoteric surfactants such as, for example, 3-cyclohexylamine-1-propane sulfonic acid.

The polyaniline composition useful in the present invention can be prepared by any method suitable for making a polyaniline salt of an organic acid suitable for formation into any of a number of useful forms. One such method particularly applicable for preparing polyaniline for use in the present invention is comprised of an emulsion polymerization process as described in copending patent application Ser. Nos. 08/335,143 and 08/596,202 pending. Such polyaniline has a molecular weight of at least about 4000 and a solubility in xylenes of at least about 5%, more preferably at least about 10%, still more preferably at least about 20% and most preferably at least about 25%. Such high solubility in xylenes or other suitable carrier solvent facilitates the processing of the polyaniline.

The method of increasing conductivity according to the present invention is applicable to treating a polyaniline salt of an organic acid either prior to processing or after it has been processed into useful forms or articles. Compositions comprised of a polyaniline salt of an organic acid are useful in drug release, in electrochromic display devices, in energy applications such as in batteries or double layer capacitors, in films and coatings including free standing films, in fibers and in antistatic materials such as in carbon composites for use in antistatic fuel lines.

Another embodiment provides for a composition comprising a polyaniline salt of an organic acid in which the polyaniline has been processed into a useful form such as a film, coating, fiber or the like. The polyaniline salt used in preparation of the useful form has a molecular weight of at least about 4000 and a solubility in xylene of at least about 25%. After processing and treatment, the polyaniline preferably has a conductivity greater than about 0.01 S/cm. After treatment, the polyaniline composition is soluble in organic solvents such as xylene, toluene and chloroform to the extent of at least about 0.5%.

In another embodiment the composition comprises a blend of a polyaniline salt of an organic acid and a binder material which imparts adherence properties to the composition.

In still another embodiment, a coating composition is provided which is prepared by the process comprising contacting the polyaniline with an ionic surfactant which results in at least a 2 fold increase in conductivity.

Among the several advantages found to be achieved by the present invention, therefore, may be noted the provision of a method for producing a polyaniline of increased conductivity which can be utilized either during or after processing; the provision of a method for increasing conductivity of polyaniline in which the polyaniline after treatment is soluble in organic solvents; the provision of a processible polyaniline with enhanced conductivity; and the provision of a polyaniline of an enhanced conductivity that has been processed into useful forms or articles such as conductive films, coatings, fibers, and the like.

DETAILED DESCRIPTION OF THE PREFERRED EMBODIMENT

Figure 1:
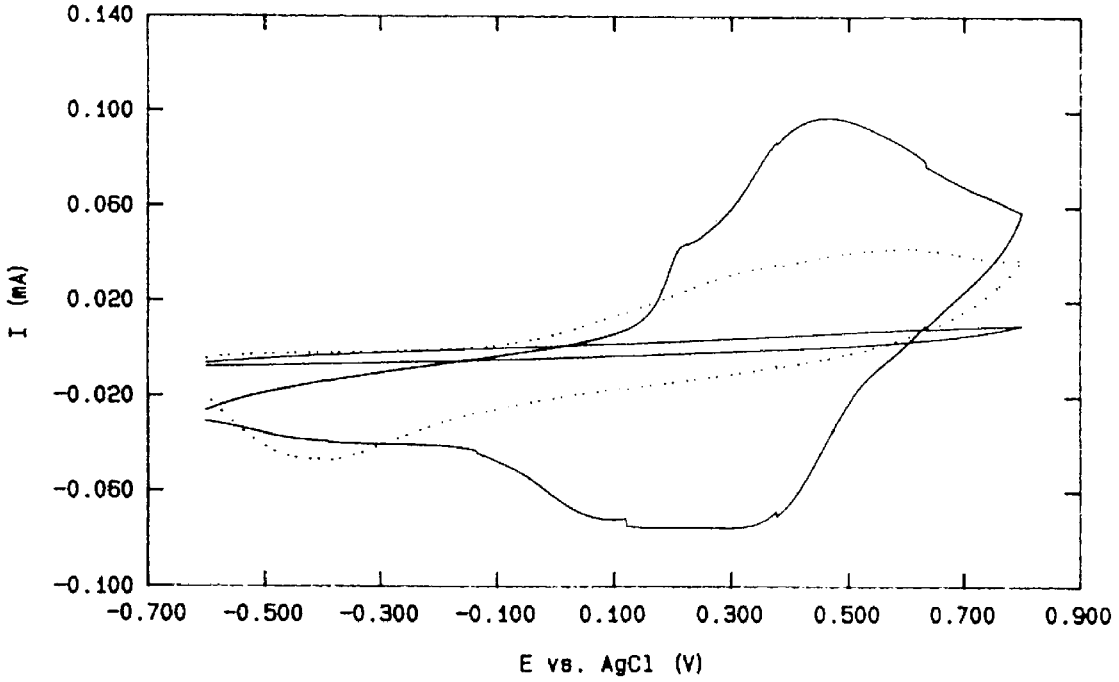
FIG. 1 illustrates the cyclic voltammetry of a film prepared from the polyaniline salt of dinonlynaphthalenesulfonic acid before (PANDA) and after treatment with benzyltriethylammonium (PANDA-BTEAC) chloride compared to a polyaniline commercially obtained from Americhem (PANI)

In accordance with the present invention, it has been discovered that the conductivity of a polyaniline composition can be increased upon contacting the polyaniline with an ionic surfactant.

A surfactant or surface-active agent as used herein is a compound that tends to locate at the interface between two phases and reduces the interfacial tension. The surfactant can reduce surface tension, i.e. the liquid/air interfacial tension, when dissolved in water or other polar solvent, or the surfactant can reduce interfacial tension between two liquids or between a liquid and a solid. Surfactants can be amphiphiles which possess a polar, hydrophilic portion of the molecule and an organic, hydrophobic portion. The polar portion of the molecule can be ionic. In general, surfactants can be divided into four classes: amphoteric, with zwitterionic head groups; anionic, with negatively charged head groups; cationic, with positively charged head groups; and nonionic, with uncharged hydrophilic head groups.

Ionic surfactants are particularly suitable for use in the methods and compositions of this invention and such ionic surfactants as referenced herein can be cationic surfactants, anionic surfactants or amphoteric surfactants or combinations thereof. Cationic surfactants may be protonated long-chain quaternary ammonium compounds and are particularly useful in the present invention as the inorganic salt form of the quaternary ammonium ion. The quaternary ammonium ion can have the structure as shown in the formula:

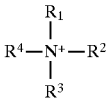

wherein each of the $R_1$, $R_2$, $R_3$ and $R_4$ are independently a $C_1$ to $C_{20}$ alkyl, aryl, arylalkyl or alkaryl group. A preferred quaternary ammonium ion within the scope of this invention is benzyltriethylammonium.

The ionic surfactants of the present invention can also be anionic surfactants. Such anionic surfactants possess anionic head groups which can include a long-chain fatty acids, sulfosuccinates, alkyl sulfates, phosphates, and sulfonates. Particularly useful in the present invention are alkali metal salts of a diphenyl oxide disulfonate having the formula:

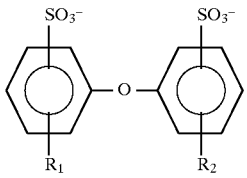

wherein $R_1$ and $R_2$ are, independently, linear or branched alkyl groups comprised of from about six to about sixteen carbons. Particularly preferred anionic surfactant are diphenyl oxide disulfonates sold under the trade names DOWFAX® 2A0(CAS No. 119345-03-8) and 2A1 (CAS No. 119345-04-9) by Dow Chemical Company (Midland, Mich.). As commercially available, the 2A0 composition contains disulfonated benzene, 1,1-oxybis-tetrapropylene derivatives at a maximum of 42%; methylene chloride at a maximum of 2%; sulfuric acid at a maximum of 1.5%; and the balance as water. The commercial composition of 2A1 contains the sodium salt of disulfonated benzene, 1,1-oxybis-tetrapropylene derivatives at a maximum of 47%; sodium sulfate at a maximum of 1%; sodium chloride at a maximum of 3%; and the balance as water. The inventors contemplate that any diphenyl oxide disulfonate can be used as surfactant including the disulfonate benzene, 1,1-oxybis-tetrapropylene derivatives in 2A0 and 2A1 whether or not the additional substituents in the commercial preparations are present. The alkali metal salts of 2A0 and 2A1 useful in the present invention include sodium salts, potassium salts and the like.

The ionic surfactant of the present invention can also be an amphoteric surfactant. Amphoteric surfactants are known in the art and can include compounds having a cationic group such as an amine or sulfonium group as well as an anionic group such as carboxyl or sulfonate group. One amphoteric surfactant particularly useful in the present invention is 3-cyclohexylamine-1-propane sulfonic acid.

In one embodiment, the ionic surfactants useful in the present invention have a hydrophobic component such that the ionic surfactant is soluble in an organic solvent such as, for example, xylenes. In this embodiment, treatment of the polyaniline salt in xylenes prior to processing into the final form is possible where both the polyaniline salt and the anionic surfactant are soluble in xylenes in an amount of at least about 1% w/w for each of the polyaniline salt and the ionic surfactant.

A preferred polyaniline composition for use in the present invention is comprised of the polyaniline salt of an organic acid. Particularly preferred is a polyaniline salt prepared by a polymerization process as described in copending patent application Ser. Nos. 08/335,143 and 08/596,202 which are incorporated in their entirety by reference. In brief, the method comprises combining water, a water-solubilizing organic solvent, and organic acid that is soluble in said organic solvent, aniline and radical initiator. A preferred organic solvent is 2-butoxyethanol. The organic acid can be any one of a number of organic acids including sulfonic acids, phosphorus-containing acids, carboxylic acids or mixtures thereof. Preferred organic sulfonic acids are dodecylbenzene sulfonic acid, dinonylnaphthalenesulfonic acid, dinonylnaphthalenedisulfonic acid, p-toluene sulfonic acid, or mixtures thereof. Most preferred is dinonylnaphthalenesulfonic acid. The polyaniline produced by this process typically has a molecular weight as measured by number average, weight average or Z average, of at least 2000, more preferably at least about 4000 still more preferably at least about 10,000 and most preferably at least about 50,000 or 100,000 or greater.

In some embodiments of the present invention, the polyaniline salt has been processed into useful forms prior to application of the method in this invention. This is possible as a result of the polyaniline composition starting material being highly soluble in any of a number of carrier solvents. In particular, the polyaniline is soluble in xylenes preferably to the extent of at least about 5%, more preferably at least about 10%, still more preferably at least about 20% and most preferably at least about 25% w/w which allows it to be processed into useful forms and articles such as for example films, fibers and the like. Alternatively, the polyaniline to be treated can be in a form suitable for further processing, i.e. dissolved in a carrier solvent.

The polyaniline useful for treatment after processing is in certain embodiments in the form of a film or coating on a substrate. Such films and coatings are continuous in that the polyaniline salt is substantially uniformly dispersed throughout the film. Furthermore, the films are substantially free of submicron size particles. For example, polyaniline salt compositions prepared by the emulsion polymerization process are comprised of not more than 5% particles having a diameter greater than 0.2 microns.

The coatings for treatment by the process of the present invention can be on a wide variety of fibers or woven fabric materials including nylon cloth, polyester cloth as well as heavier fabric material such as is used in carpet backing which is typically a polypropylene. Any suitable method can be used for coating the fiber or fabric material with the polyaniline salt in preparation for the treatment of the present invention. For example, the material can be dipped into a solution of the polyaniline salt or sprayed with a solution containing polyaniline salt in an appropriate carrier solvent and then dried. Such drying can be performed, for example, in an oven at 70° C. under reduced pressure of 20 mm Hg for about 10 minutes. Alternatively, the polyaniline coating can be air dried for a longer period such as overnight. After coating the fabric or material, treatment by contacting the fabric or material with an ionic surfactant causes an increase in the conductivity of the polyaniline coating.

Preferably, the ionic surfactant is dissolved in water at a concentration of from about 0.005M to about 2M, more preferably from about 0.01M to about 1M and most preferably from about 0.05M to 0.5M. The amount of increase in conductivity will depend upon the particular ionic surfactant used, the concentration of the surfactant, the time of the contact with the polyaniline salt and the temperature at which the surfactant is contacted with the polyaniline salt. For a given ionic surfactant, a high concentration of the surfactant will produce the same increase in conductivity in a shorter period of time than a lower concentration of the surfactant. Moreover, temperatures higher than room temperature can produce a greater increase in conductivity. One skilled in the art can readily determine the required contacting time for a particularly selected ionic surfactant and concentration of that ionic surfactant. The contacting time suitable for increasing the conductivity can be from as little as about 2 seconds to as long as about 1 hour or more depending upon the ionic surfactant, the concentration of that surfactant and the increase in conductivity desired to be achieved. Thus, preferred as a time for contacting the ionic surfactant with the polyaniline composition is at least about 2 seconds, at least about 10 seconds, at least about 30 seconds, at least about 1 minute, at least about 10 minutes, at least about 1 hour or more. Furthermore, one skilled in the art can readily determine the temperature for treating the polyaniline salt with surfactant. Preferably, the temperature is in a range of from about 10° C. to about 90° C., more preferably from about 15° C. to about 80° C. and most preferably from about 20° C. to about 60° C. As used herein, room temperature is intended to mean a temperature preferably within the range of about 18° C. to about 24° C. and more preferably from about 20° C. to about 22° C.

The method of contacting the fabric or fabric material can be by any suitable method including dipping the coating in a solution of the ionic surfactant or spraying the fiber or fabric material with surfactant solution. After removing excess surfactant and measuring the conductivity a substantial increase in conductivity is observed. Upon drying the coating, the treated coating again shows a substantial increase in conductivity compared to the coating prior to treatment. As noted above, the fabric materials prior to treatment typically have a resistance of greater than about 1 GΩ ($=10^9\Omega$), i.e. conductivity is less than $10^{-9}$ Siemen ($10^{-9}$ S or $10^{-9}\Omega^{-1}$). After preparing a coating of the polyaniline salt composition, the conductivity of the coating is increased by contacting with the surfactant. The increase in conductivity is preferably by at least a factor of about 2. More preferably, conductivity is increased by a factor of about 10; still more preferably, by a factor of about 100; and most preferably, by a factor of about 1000 or greater.

Polyaniline films can also be treated by this method to enhance the conductivity of the film or coating on the surface of a solid substrate such as metal, glass or plastic. In forming the coating to be treated, the polyaniline salt is dissolved in a suitable carrier solvent and applied to the substrate by any conventional method of application such as by spraying, by brush application, by dipping the solid substrate into a solution containing the polyaniline, by electrophoretic coating or the like. If application is from a solvent vehicle, the solvent can then be removed by air drying or by drying in an oven under reduced pressure. As noted above, the films and coatings thus prepared are continuous prior to treatment in that the polyaniline salt is substantially uniformly dispersed throughout the film and substantially free of submicron size particles. In certain embodiments the film or coating is comprised of not more than 5% particles having a diameter greater than 0.2 microns such as when prepared by the emulsion polymerization process. After treatment, the films show a "foam-like" network structure which the inventors believe result from a reorientation of the polyaniline into conductive, networking pathways.

Prior to treatment such films show high resistance and the particular values depend upon the dimensions of the film. Films having a width 1.5 inches, a thickness of 0.015 cm, and 0.25 inches between measurement points for two-point resistance measurement typically show a resistance of between about 0.1 to about 10 megohms. The conductivity of such films can be within the range of from about $10^{-1}$ to about $10^{-6}$ S/cm prior to treatment. The heating of the film can produce a small increase in conductivity of up to about 10 fold change compared to air drying of the film, however, the film still shows a low conductivity. Thus, after heating or air drying the film, conductivity remains low. Upon treatment of the film by contacting with an ionic surfactant, however, conductivity is substantially increased.

The coating compositions of the present inventions with high conductivity can also be comprised of a blend with a binder material. The binder material imparts suitable adherence properties to the polyaniline salt composition of the present invention so that it is capable of adherence to a solid surface or object. Any binder material capable of providing the necessary adherence properties to the blend and capable of being blended with the polyaniline salt composition can be used in connection with the present invention. Such binder materials convert to a dense, solid, adherent coating on a metal surface. The binder material may be an inorganic compound such as a silicate, a zirconate, or a titanate or an organic compound such as a polymeric resin. Exemplary organic resins include shellac, drying oils, tung oil, phenolic resins, alkyd resins, aminoplast resins, vinyl alkyds, epoxy alkyds, silicone alkyds, uralkyds, epoxy resins, coal tar epoxies, urethane resins, polyurethanes, unsaturated polyester resins, silicones, vinyl acetates, vinyl acrylics, acrylic resins, phenolics, epoxy phenolics, vinyl resins, polyimides, unsaturated olefin resins, fluorinated olefin resins, crosslinkable styrenic resins, crosslinkable polyamide resins, rubber precursor, elastomer precursor, ionomers, mixtures and derivatives thereof, and mixtures thereof with crosslinking agents. In a preferred embodiment of the present invention, the binder material is a cross-linkable binder (a thermoset), such as the epoxy resins, polyurethanes, unsaturated polyesters, silicones, phenolic and epoxy phenolic resins. Exemplary cross-linkable resins include aliphatic amine-cured epoxies, polyamide epoxy, polyamine adducts with epoxy, ketimine epoxy coatings, aromatic amine-cured epoxies, silicone modified epoxy resins, epoxy phenolic coatings, epoxy urethane coatings, coal tar epoxies, oil-modified polyurethanes, moisture cured polyurethanes, blocked urethanes, two component polyurethanes, aliphatic isocyanate curing polyurethanes, polyvinyl acetals and the like, ionomers, fluorinated olefin resins, mixtures of such resins, aqueous basic or acidic dispersions of such resins, or aqueous emulsions of such resins, and the like. Methods for preparing these polymers are known or the polymeric material is available commercially. Suitable binder materials are described in "Corrosion Prevention by Protective Coatings" by Charles G. Munger (National Association of Corrosion Engineers 1984 which is incorporated by reference). It should be understood that various modifications to the polymers can be made such as providing it in the form of a copolymer. The binder can be either aqueous based or solvent based.

The binder material can be prepared and subsequently blended with the polyaniline salt composition or it can be combined with the polyaniline salt composition and treated or reacted as necessary. When a cross-linkable binder is used, the binder may be heated, exposed to ultraviolet light, or treated with the cross-linking component subsequent to the addition of the polyaniline salt composition or concurrently therewith. In this manner it is possible to create a coating composition where the polyaniline salt composition is cross-linked with the cross-linkable binder.

Cross-linkable binders particularly suitable for this application include the two component cross-linkable polyurethane and epoxy systems as well as the polyvinylbutyral system that is cross-linked by the addition of phosphoric acid in butanol. Typical polyurethane coatings are made by reacting an isocyanate with hydroxyl-containing compounds such as water, mono-and diglycerides made by the alcoholysis of drying oils, polyesters, polyethers, epoxy resins and the like. Typical epoxy coatings are prepared by the reaction of an amine with an epoxide, e.g., the reaction of bisphenol A with epichlorohydrin to produce an epoxide that is then reacted with the amine. A novel blending method could, for example, involve polymerizing the polyaniline salt in a host polymer matrix such as polyvinylbutyral. When epoxies or polyurethanes are used as the host polymer matrix, a blend of polyaniline and the base polymer could be formulated and the cross-linking catalyst added just prior to the coating application. In an alternate embodiment, the polyaniline salt composition is blended with the cross-linking catalyst.

Such blends of a polyaniline salt composition and binder within the scope of the present invention are also referenced herein as continuous films or coatings as a result of the polyaniline salt being substantially uniformly dispersed throughout the film prior to treatment. In certain embodiments such as when the polyaniline is prepared by the emulsion polymerization process, the film is comprised of not more than 5% of the polyaniline in the form of particles which have a diameter greater than 0.2 microns.

The conductivity of such films or coatings comprised of blends containing the polyaniline salt of an organic acid is enhanced by contacting the film or coating with the ionic surfactant in solution. Upon drying, the treated film or coating shows a substantial increase in conductivity compared to that prior to treatment.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples.

EXAMPLES 1–6

This example illustrates the increase in conductivity of a polyaniline film treated with benzyltriethylammonium chloride.

The polyaniline salt of dinonylnaphthalenesulfonic acid was prepared by the process in copending applications Ser. No. 08/335,143 and 08/596,202 by overnight polymerization from a starting mixture of water, 2-butoxyethanol, dinonylnaphthalenesulfonic acid and aniline in an acid to aniline mole ratio of 1.6:1. The resultant green phase containing the polyaniline salt in 2-butoxyethanol was dissolved in xylenes as carrier solvent and coated on to a substrate. The substrate consisted of a 2.5 inch square mylar plate onto which four gold strips of 0.25 inches in width and spaced apart by 0.25 inches were sputter deposited. The polyaniline was coated on to the substrate in a film having a width of 1.5 inches using a draw bar method (see, for example, Allcock and Lampe, *Contemporary Polymer Chemistry, 2nd Ed.*, Prentice Hall, Englewood Cliffs, N.J., 1990, pp. 501–2 which is incorporated by reference). The substrate and coated polyaniline film were allowed to dry in the air at room temperature overnight and then dried in a partial vacuum oven at 10–20 mm Hg for 7 hours at 70° C.

The wet thickness of the dried polyaniline film was estimated to be 0.006 inches. Dry film thickness was measured by using a Digit Electronic Macrometer (model Ultral Digit Mark IV; Fowler and Sylvan Co.).

Resistance was measured using a Keithley Voltameter Model No. 2001 multimeter (Keithley Instruments, Inc. Cleveland, Ohio) by the two probe method. This method involved the measurement of resistance between two adjacent gold strips. The conductivity of the polyaniline film was calculated in S/cm ($\Omega^{-1}cm^{-1}$) as the distance between the electrodes (0.25 inches) divided by the product of the width of the film, the thickness of the film and the measured resistance.

The film was then treated with an aqueous solution of benzyltriethylammonium chloride (BTEAC, 0.01, 0.05 or 0.5M) by dipping the substrate and coated polyaniline film into the solution, making sure that of the polyaniline film is fully immersed. Treatment was for a period of either 30 seconds or 10 minutes. Excess solution was removed from the film by wiping with a tissue and the conductivity immediately measured (referenced in Table 1 under the heading FILM BLOTTED DRY). The film was then dried in a partial vacuum oven at 10–20 mm Hg for 3.5 days at 70° C. after which the conductivity was again determined (referenced in Table 1 under the heading FILM DRIED BY HEAT UNDER VACUUM). Results are shown in Table 1.

TABLE 1

| | .01M BTEAC[a] | | 0.05M BTEAC[a] | | .5M BTEAC[a] | |
|---|---|---|---|---|---|---|
| | Example | | | | | |
| | 1 | 2 | 3 | 4 | 5 | 6 |
| | Treatment Time | | | | | |
| | 30 sec. | 10 min. | 30 sec. | 10 min. | 30 sec. | 10 min. |
| PRETREATMENT | | | | | | |
| Substrate (mg) | 830.9 | 819.0 | 792.6 | 784.3 | 810.7 | 850.5 |
| Dried film[b] (Δ mg) | 158.6 | 148.3 | 233.8 | 200.1 | 180.4 | 153.5 |
| Resistance ($\Omega \times 10^6$) | 5.1 | 3.3 | 4.7 | 3.6 | 2.1 | 3.9 |
| Conductivity ($(S/cm) \times 10^{-6}$) | 7.6 | 9.7 | 7.0 | 6.5 | 12.0 | 8.1 |
| POST-TREATMENT | | | | | | |
| FILM BLOTTED DRY | | | | | | |
| Resistance ($\Omega \times 10^6$) | 0.130 | 0.015 | 0.025 | 0.013 | 0.0082 | 0.00079 |
| Conductivity: | | | | | | |
| $(S/cm) \times 10^{-6}$ | 300 | 21,000 | 1,300 | 18,000 | 2,900 | 40,000 |
| Fold Increase | 39 | 2,200 | 180 | 2,800 | 240 | 4,900 |
| FILM DRIED BY HEAT UNDER VACUUM[c] | | | | | | |
| Mass (mg) | 157.6 | 150.9 | 233.8 | 168.6 | 176.1 | 154.5 |
| Resistance ($\Omega \times 10^6$) | 0.190 | 0.100 | 0.320 | 0.074 | 0.360 | 0.022 |
| Conductivity: | | | | | | |
| $(S/cm) \times 10^{-6}$ | 200 | 320 | 100 | 320 | 67 | 1,400 |
| Fold Increase | 26 | 33 | 14 | 49 | 6 | 170 |

[a] - Benzyltriethylammonium chloride.
[b] - Dried for 7 hours at 70° C.
[c] - Dried for 3.5 days at 70° C.

As shown in the table, contacting the film with 0.01M solution of benzyltriethylammonium chloride (BTEAC) at a concentration of 0.01M for 30 seconds increased conductivity by a factor of approximately 39 fold. Thirty seconds treatment with higher concentrations of BTEAC (0.05M and 0.5M) produced greater increases in conductivity of 180 and 240, respectively. After 10 min exposure to 0.01M, 0.05M or 0.5M BTEAC, the films showed substantial increases in conductivity of 2200, 2800 and 4900 fold compared to pretreatment values. Thus, the increase in conductivity is dependent upon both the concentration of surfactant and time of exposure of the film to the surfactant.

At the end of 3.5 days of drying under heat and partial vacuum, the conductivity increase initially produced was diminished, however, conductivity still remained above pretreatment values. Films that had been earlier treated with BTEAC for 30 seconds continued to show increased conductivity of approximately 6 to 26 fold above pretreatment values and films treated for 10 min showed an increase in conductivity of approximately 33 to 1700 fold above pretreatment values.

EXAMPLE 7

This example illustrates the solubility of surfactant-treated polyaniline films in organic solvents.

Films were prepared from the polyaniline salt of dinonylnaphthalene sulfonic acid and treated with BTEAC as in examples 1–6. The solubilities of the films in various organic solvents were then determined. Treated films and substrates were placed in 0.5 ml of an organic solvent (toluene, xylenes or chloroform) for a period of approximately 30 minutes. Sonication was applied for about 2 minutes to facilitate dissolution. The films were found to be soluble in each of the solvents which became dark green in color due to the presence of the emaraldine salt in the solvent. In the toluene solubility test, a film having a mass of 0.003 grams was completely dissolved in the toluene which indicated that the toluene solubility of films treated with BTEAC is at least 0.7% w/w (0.003 g/(0.5 ml×0.866 g/ml)). A second film of 0.004 grams completely dissolved in xylenes indicating that the solubility of treated films in xylenes is at least 0.8% w/w (0.004 g/(0.5 ml×0.860 g/ml)). A third film of 0.004 grams was immersed in chloroform and completely dissolved indicating that treated films are soluble in chloroform to the extent of at least 0.5% (0.004 g/(0.5 ml×1.475 g/ml)). Thus, after treatment with BTEAC, the films are soluble in organic solvents at least to the extent of 0.5%.

EXAMPLE 8–17

This example illustrates the increase in conductivity of films of polyaniline salt of dinonylnaphthalenesulfonic acid treated with cationic, anionic and amphoteric surfactants at room temperature and at 58° C.

Films were prepared and treated with surfactants as in Examples 1–6. The treatment was at either room temperature or at 58° C. The treated films were blotted dry and resistance measured as in Examples 1–6. The films were then further dried by heating at 70° C. under partial vacuum of 10–20 mmHg for 10 minutes (except for examples 4 and 6 which were treated as indicated above) and the resistance again measured.

Films were treated with the cationic surfactant, benzyltriethylammonium chloride (BTEAC) at concentrations of 0.05 or 0.5M (Table 2).

TABLE 2

| | Surfactant | | | | | | | | | | | |
|---|---|---|---|---|---|---|---|---|---|---|---|---|
| | BTEAC[a] (0.05M) | | BTEAC[a] (0.5M) | | DF2A1 (5%) | | DF2A1 (17%) | | DF2A0 (16%) | DF8339 (5%) | CAPS[d] (0.1M) | |
| | Example | | | | | | | | | | | |
| | 4 | 8 | 6 | 9 | 10 | 11 | 12 | 13 | 14 | 15 | 16 | 17 |
| | Treatment Temperature | | | | | | | | | | | |
| | Room Temp. | 58° C. | Room Temp. | 58° C. | Room Temp. | 58° C. | Room Temp. | 58° C. | 58° C. | 58° C. | Room Temp. | 58° C. |
| | PRETREATMENT | | | | | | | | | | | |
| Resistance ($\Omega \times 10^6$) | 3.6 | 2.8 | 3.9 | 2.4 | 2.7 | 3.7 | 2.3 | 2.3 | 3.0 | 2.9 | 5.2 | 4.5 |
| Conductivity (S/cm) × $10^{-6}$ | 6.5 | 12.0 | 8.1 | 63.0 | 8.2 | 7.7 | 16.0 | 18.0 | 29.0 | 12.0 | 7.6 | 9.0 |
| | POST-TREATMENT | | | | | | | | | | | |
| FILM BLOTTED DRY | | | | | | | | | | | | |
| Resistance ($\Omega \times 10^6$) | 0.013 | 0.00025 | 0.00079 | 0.0025 | 0.020 | 0.001 | 0.015 | 0.00041 | 0.003 | 0.00051 | 0.030 | 0.00071 |
| Conductivity: | | | | | | | | | | | | |
| (S/cm) × $10^{-6}$ | 18,000 | 130,000 | 40,000 | 610,000 | 2,000 | 28,000 | 2,500 | 92,000 | 300,000 | 71,000 | 1,300 | 57,000 |
| Fold Increase | 2,800 | 11,000 | 4,900 | 9,700 | 240 | 3,600 | 156 | 5,100 | 10,000 | 5,900 | 170 | 6,300 |
| FILM DRIED BY HEAT UNDER VACUUM[b] | | | | | | | | | | | | |
| Resistance | 0.074[c] | 0.210 | 0.022[c] | 0.060 | 0.045 | 0.039 | 0.036 | 0.0012 | 0.003 | 0.0013 | 3.6 | 1,300 |
| Conductivity: | | | | | | | | | | | | |
| (S/cm) × $10^{-6}$ | 320[c] | 160 | 1,400[c] | 2,500 | 490 | 7,300 | 1,000 | 35,000 | 30,000 | 28,000 | 11 | 31,000 |
| Fold Increase | 49 | 13 | 170 | 40 | 60 | 950 | 62 | 1,900 | 1,000 | 2,300 | 1.4 | 3,400 |

[a] - Benzyltriethylammonium chloride treatment.
[b] - Treated film was dried at 70° C. under 10–50 mm Hg vacuum for 10 minutes unless otherwise indicated.
[c] - Treated film was dried at 70° C. under 10–20 mm Hg vacuum for 3.5 days.
[d] - 3-cyclohexyloamine-1-propane sulfonic acid.

Treating the films at 58° C. for 10 minutes followed by blotting the films dry produced a greater increase in conductivity than was seen when the films were treated at room temperature for 10 minutes. In addition, as was noted above, the increase in conductivity was also dependant upon the concentration of surfactant in that a greater increase in conductivity was seen with BTEAC at a concentration of 0.5M than with 0.05M. Drying at 70° C. under partial vacuum resulted in a diminution of the increase in conductivity both after 10 minutes of drying at 70° C. and after 3.5 days of drying at 70° C.

Films were also treated with the anionic surfactant DOWFAX® 2A1 (DF2A1, 5% or 17% w/w) and the anionic surfactant DOWFAX® 2A0 (16% w/w). As commercially available, DF2A1 (CAS No. 119345-04-9; Dow Chemical Company; Midland, Mich.) is in a solution having a pH of about 5 to about 6 which contains the sodium salt of disulfonated benzene, 1,1-oxybis-tetrapropylene derivatives at a maximum of 47%; sodium sulfate at a maximum of 1%; sodium chloride at a maximum of 3%; and the balance as water. The commercially available DF2A0 (CAS No. 119345-03-8; Dow Chemical Company; Midland, Mich.) is in a solution having a pH of about 1.0 which contains disulfonated benzene, 1,1-oxybis-tetrapropylene derivatives at a maximum of 42%; methylene chloride at a maximum of 2%; sulfuric acid at a maximum of 1.5%; and the balance as water.

As was seen with the cationic surfactant, BTEAC, the anionic surfactant, DF2A1 also produced an increase in conductivity that was dependant upon both temperature of treatment and concentration of surfactant. The increase in conductivity was greater when the films were treated at 58° C. than at room temperature. Furthermore, the higher concentration of DF2A1 of 16% produced a greater increase in conductivity in films treated at 58° C. than did the 4% composition. A decrease in conductivity was seen after heat drying the treated films, however, conductivity still remained above pre-treatment values.

The anionic surfactant DF2A1 was in a composition at a pH of 5–6 such that this surfactant was essentially completely in the salt form compared to DF2A0 which at a pH of 1 was only partially in the salt form. As seen in Table 2, DF2A1 produced increases in conductivity similar to those produced by DF2A0. Because DF2A1 is in the salt form, the comparable activity of DF2A1 and DF2A0 supports the conclusion that the salt form and not the protonated form of both surfactants is active in producing the increase in conductivity.

Another commercially available anionic surfactant is a diphenyloxide disulfonate containing linear 16-carbon alpha-olefin groups as the hydrophobe source and average molecular weight of 643, which is sold under the trade name DOWFAX® 8390 (DF8390) (CAS No. 65143-89-7; Dow Chemical Company; Midland, Mich.). The commercially available material contains disodium hexadecyldiphenyloxide disulfonate, 15–35%, disodium dihexadecyldiphenyloxide disulonate, 5–10%, sodium sulfate at a maximal concentration of 3%, sodium chloride at a maximal concentration of 3% and water for the balance.

As was observed for DF2A0 and DF2A1, DF8390 also increased conductivity after treatment and blotting dry and the treated film continued to show increased conductivity, although diminished in magnitude, after drying with heat under partial vacuum.

The amphoteric surfactant, 3-cyclohexylamine-1-sulfonic acid (CAPS) produced a modest increase in conductivity when treating a film at room temperature, however, the conductivity decreased to a value comparable to the pre-treatment value after drying with heat under partial vacuum. In contrast to this, treating the film with CAPS at 58° C. produced a substantial increase in conductivity after blotting the film dry and conductivity remained high after heating under partial vacuum even though some decline in conductivity was observed. Thus, the increase in conductivity elicited by CAPS is directly dependent upon treatment temperature as was the case for cationic and anionic surfactants.

Thus treatment with cationic, antionic and amphoteric surfactants produced increases conductivity, the increases in conductivity were higher after blotting the film dry compared to drying the film under heat and partial vacuum, treatment at 58° C. produced a larger increase in conductivity than treatment at room temperature, and higher concentrations of surfactant produced larger increases in conductivity.

EXAMPLE 18

This example illustrates the cyclic voltammetry of a film prepared from the polyaniline salt of dinonylnaphthalenesulfonic acid and subsequently treated with benzyltriethylammonium chloride.

The polyaniline salt of dinonyhlnaphthalenesulfonic acid was prepared as described in Examples 1–6 and coated on a glassy carbon electrode. Cyclic voltammograms were performed using a Potentiostat/Galvanostat (Model 273, Princeton Applied Research, Princeton, N.J.). The experiment was performed in a 1.7 cm by 5.5 cm cell equipped with a septa, a AgCl reference electrode, a Pt counter electrode and the glassy carbon working electrode with polyaniline film. NaCl (3.5%) was used as the electrolyte.

Prior to treatment with benzyltriethylammonium chloride (BTEAC), the polyaniline films showed no oxidation or reduction peaks between −0.8 and +0.8 volts referenced to the AgCl electrode (FIG. 1). After treatment with BTEAC (0.1M), the film exhibited a strong, reversible oxidation reduction peak at approximately 0.4 volts (FIG. 1). The redox couple is believed to be due to a reversible oxidation/reduction between the emeraldine and leuco forms of the polyaniline. Thus, the treatment with BTEAC increased the rate of electron transfer to the polyaniline film. For comparative purposes, a film of commercially obtained polyaniline (thermoplastic conductive coating; product name 37828-WI Green; Americhem, Inc., Cuyahoga Falls, Ohio) was prepared on a carbon electrode and cyclic voltammetry performed. Results showed that the comparative commercial polyaniline exhibited less reversible electron transfer.

EXAMPLE 19

This example illustrates the transmission electron micrography of a film prepared from the polyaniline salt of dinonylnaphthalenesulfonic acid and treated with benzyltriethylammonium chloride.

The polyaniline salt of dinonyhlnaphthalenesulfonic acid was prepared as described in Examples 1–6 and dissolved in xylenes at a concentration of 5%. Electron beam transparent thin films were prepared by dipping a gold grid into the solution. Thin films of the polyaniline salt were obtained by drying the grid in air for approximately 10 minutes. The thin films were directly examined in the electron microscope.

Transmission electron microscopy (TEM) was carried out using a JEOL 200FX instrument with an image resolution of 0.3 nm. The microscope was operated at 200 kV. The vacuum in the specimen chamber area was approximately $10^{-5}$ Pa. Digital TEM images were obtained using a Charge-Coupled Device camera (Gatan Inc.).

After initial TEM images were recorded, the samples were removed from the microscope and treated with 0.1M aqueous solution of benzyltriethylammonium chloride (BTEAC) for 2 minutes.

Figure 2A:
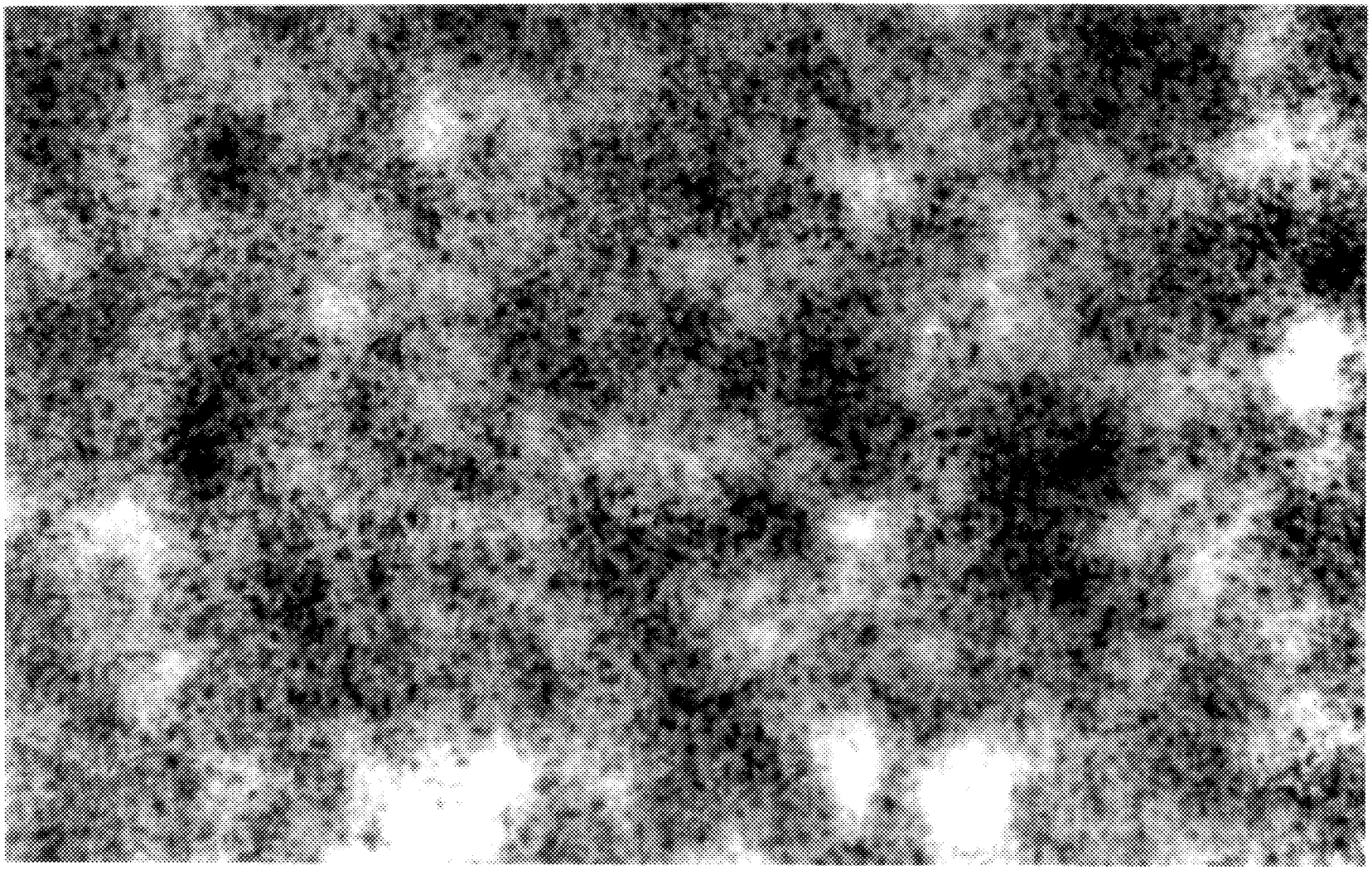
FIG. 2 illustrates the transmission electron micrographs of (a) a film prepared from polyaniline composition comprising the polyaniline salt of dinonylnaphthalenesulfonic acid and (b) a film prepared from the same polyaniline composition and treated by contacting the film with benzyltriethylammonium chloride.
Figure 2B:
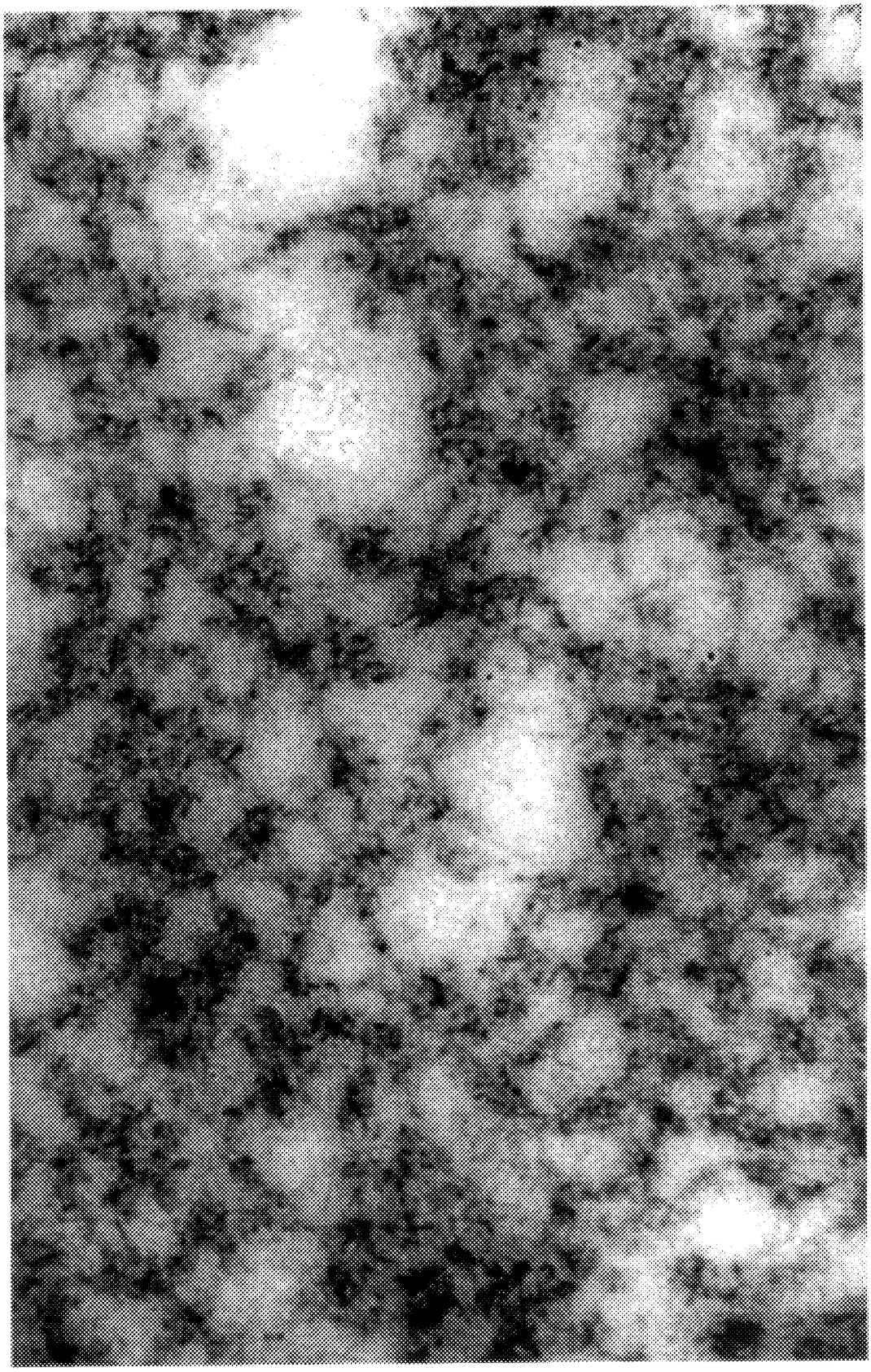

The bright field TEM of the untreated film showed dark spots or domains which represent the polyaniline which is thought to be conductive and brighter regions representing the dopant phase which is thought to be non-conductive (FIG. 2*a*). The bright field TEM image of a film treated for 2 minutes with BTEAC also showed darker domains of polyaniline and brighter regions of dopant phase (FIG. 2*b*).

The morphology of the treated films differed substantially from the non-treated film. In the non-treated film, small islands of polyaniline were embedded in the dopant matrix which appeared to be amorphous. Some of these small islands are aggregated to form domains which are believed to be conductive domains. The distribution of the small islands may affect the overall conductivity of the film. After treatment with BTEAC, an inter-connected network of dark, polyaniline was observed. This may represent a movement and self-assembly of the small islands to form multiple connected pathways. This development of an interconnecting network of presumably conductive pathways may be responsible for the observed substantial increase in conductivity of the film.

EXAMPLE 20

This example illustrates the absorbance spectrum of a film prepared from the polyaniline salt of dinonylnaphthalenesulfonic acid and treated with benzyltriethylammonium chloride.

Films of the polyaniline salt of dinonylnaphthalenesulfonic acid were prepared on a mylar substrate as described in Examples 1–6 by spin coating at a spinning speed of 2000 rpm. The UV spectroscopy was then performed on films without and with treatment with benzyltriethylammonium chloride. UV spectra were obtained using a Cary 5 UV-Vis-Near IR spectrometer over a spectral range of from 300 nm to 3300 nm.

Figure 3:
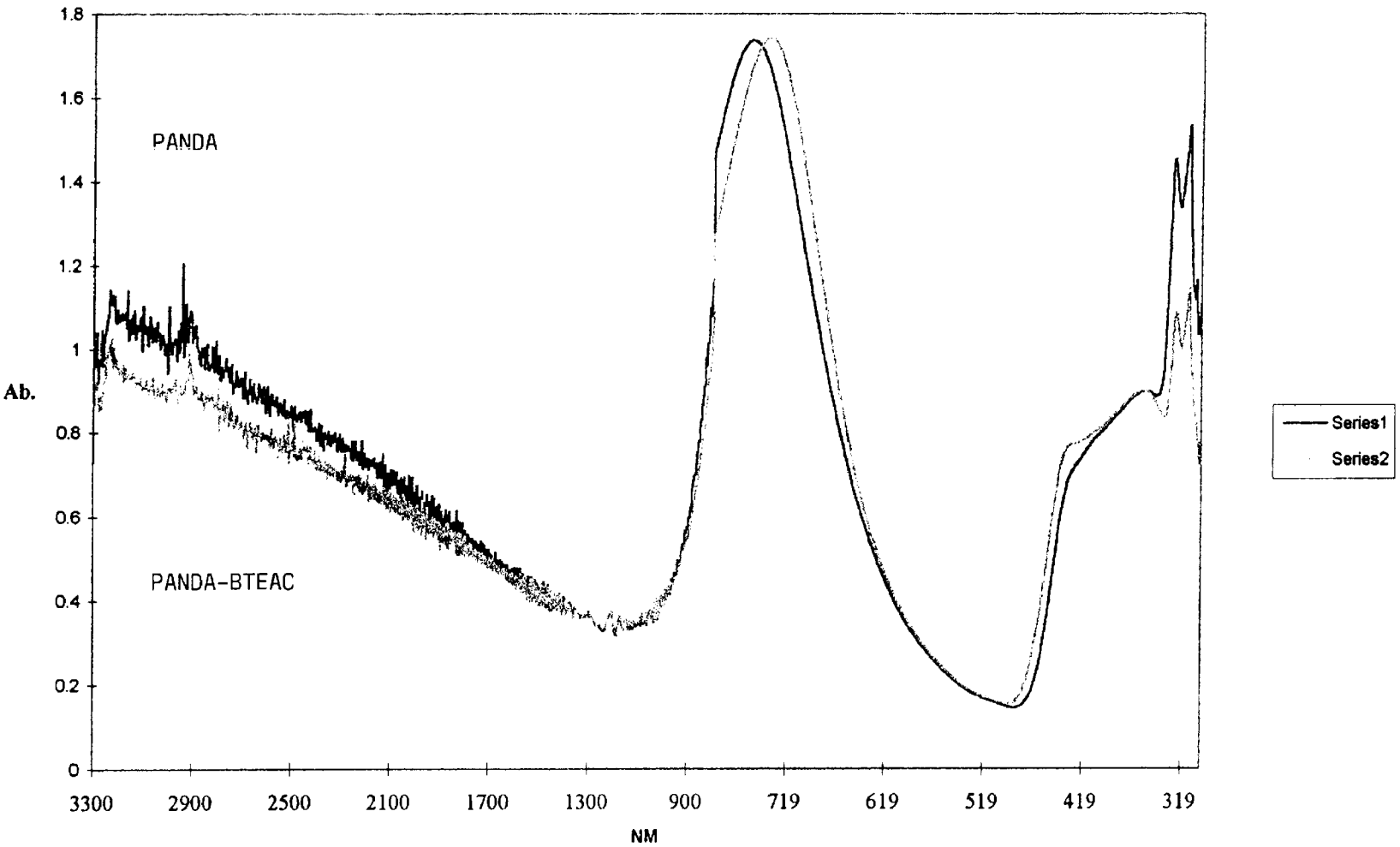
FIG. 3 illustrated the UV spectra of a film prepared from the polyaniline composition comprising the polyaniline salt of dinonylnaphthalenesulfonic acid (PANDA) and a film prepared from the same polyaniline composition and treated by contacting the film with benzyltriethylammonium chloride (PANDA-BTEAC).

As shown in FIG. 3, both the untreated and treated films showed absorption at approximately 450 nm, a prominent absorption peak at approximately 800 nm and a tailing commencing at approximately 1300 nm and steadily increasing to about 3200 nm. The spectrum in the treated film was otherwise virtually identical to that of the untreated film with the exception that the peak at approximately 800 nm showed a slight red shift.

EXAMPLE 21–25

This example illustrates the increase in conductivity of a polyaniline coating on nylon fabric upon treating with an cationic or anionic surfactants.

The polyaniline salt of dinonylnaphthalenesulfonic acid was prepared as described in Examples 1–6 and 7.2 g was dissolved in 50 ml xylenes for coating on to fabric samples. Each test was performed in triplicate using strips of nylon cloth approximately 5.5 cm×1.3 cm. The fabric strips were each weighed and then immersed in the polyaniline salt solution for approximately 10 minutes. The coated fabric strips were then removed and dried in a partial vacuum oven at 20 mm Hg at 70° C. for 10 min. Weights were again obtained and the increase in weight due to the polyaniline film calculated.

The conductivity of each strip was then determined using a Keithley Voltameter Model 2001 using a two probe method by attaching copper alligator clips to each end of a fabric strip. The coated fabric strips were then dipped in a treating solution containing a surfactant, removed and placed in the drying oven at 70° C. for 30 min after which conductivity was measured. Drying was then continued overnight (approximately 12 hours) and the fabric strips were weighed and conductivity again measured. The strips were then washed with deionized water by inserting into 50 ml of water for 10 min with changing of the water twice during that period. After drying in the partial vacuum oven as above and conductivity was again measured.

The resistance of the fabric strips prior to treatment was greater than the measuring limit of the voltameter which was 1 GΩ (=$10^9$Ω), i.e. conductivity was less than $10^{-9}$ Siemen ($10^{-9}\Omega^{-1}$). Treatment solutions were all prepared in deionized water at the following concentrations: Benzyltriethylammonium chloride (BTEAC, 0.5M); DOWFAX 2A0 (DF2A0), 4.0 g/25 ml water; DOWFAX 8390 (DF8390), 4.25 g/25 ml water; LF-Harzda 6817639, BASF surfactant (BASF Aktiengesellschaft, Ludwigshafen, Germany) 5.0 g/25 ml water; and camphorsulfonic acid (CASA, 0.5M). Table 3 reports the means of three measured values for film mass and conductivity under the various conditions and treatments.

TABLE 3

| | Example | | | | |
|---|---|---|---|---|---|
| | 21 BTEAC (0.5M) | 22 DF2AO (16%) | 23 DF8390 (17%) | 24 BASF (20%) | 25 CASA (.05M) |
| PRETREATMENT | | | | | |
| Film Mass (mg) | 15.6 | 14.0 | 14.2 | 14.7 | 18.3 |
| Conductivity ($S \times 10^{-6}$) | <0.001 | <0.001 | <0.001 | <0.001 | <0.001 |
| POST-TREATMENT | | | | | |
| DRYING 30 MINUTES AT 70° C. UNDER PARTIAL VACUUM | | | | | |
| Conductivity ($S \times 10^{-6}$) | 0.44 | 2.8 | 0.05 | 0.003 | <0.011 |
| DRYING OVERNIGHT AT 70° C. UNDER PARTIAL VACUUM | | | | | |
| Conductivity ($S \times 10^{-6}$) | 0.08 | 62.4 | 0.024 | <0.001 | <0.002 |
| WASH AND DRYING AT 70° C. UNDER PARTIAL VACUUM | | | | | |
| Conductivity ($S \times 10^{-6}$) | 0.053 | 3.2 | <0.001 | 0.20 | <0.001 |

Prior to treatment, the conductance of the nylon strips coated with polyaniline was less than $10^{-9}$ Siemen. Conductivity substantially increased after treatment and drying for 30 minutes by a factor of at least 440 fold with the cationic surfactant, benzyltriethylammonium chloride (BTEAC), 2800 fold for the anionic surfactant, DOWFAX 2A0 (DF2A0) and 50 fold for the anionic surfactant DF8390.

Drying and washing also produced different effects on conductivity in the BTEAC and DF2A0 treated coatings. In BTEAC treated coatings overnight drying substantially diminished the increase in conductivity elicited by the surfactant and this was only slightly further diminished upon washing. Coated fabrics treated with DF2A0, on the other hand, showed a substantial enhancement in conductivity upon overnight drying, but then showed a substantial diminution of the increase in conductivity following the wash. In view of the decrease in coating weight at the time of washing, it is possible that the washing resulted in a loss of polyaniline from the coating and that this resulted in the diminution of the increase elicited by DF2A0.

Treatment with DF8390 produced a modest increase in conductivity which disappeared upon washing. The decrease in conductivity and film mass upon washing with this anionic surfactant is consistent with what was observed with DF2A0.

Neither BASF, a cationic polymeric surfactant containing quaternary nitrogen atoms, nor CASA, camphorsulfonic acid which is considered a primary dopany for polyaniline, produced substantial increases in conductivity.

EXAMPLE 26

This example illustrates the increase in conductivity of a polyaniline coating on polyester fabric and carpet backing upon treating with benzyltriethylammonium chloride.

The samples of fabric material, either cloth or carpet backing, were each cut into three strips of material having the dimensions of 11 cm by 3 cm and each strip was immersed for 10 min in a solution of the polyaniline salt of dinonylnaphthylenesulfonic acid (PANI) in xylenes as described in Examples 21–25. The material was then removed and dried in a vacuum oven at 70° C. under partial vacuum of 10–20 mm Hg for 10 min followed by a 10 min immersion in a bath containing benzyltriethylammonium chloride (BTEAC, 0.25M) and subsequent drying overnight under the same conditions of temperature and vacuum. Resistance prior to treating the coatings was greater than 1 G Ω and conductivity was less than $10^{-9}$ Siemen. Results are shown in Table 4.

TABLE 4

| | PANI-Coated, BTEAC-Treated Fabric Strip (mass in mg) | Conductivity ($S \times 10^{-6}$) |
|---|---|---|
| | POLYESTER CLOTH | |
| 1 | 360 | 0.24 |
| 2 | 356 | 0.25 |
| 3 | 355 | 0.22 |
| Mean | 357 | 0.24 |
| | CARPET BACK | |
| 1 | 475 | 1.00 |
| 2 | 479 | 0.26 |
| 3 | 474 | 2.5 |
| Mean | 476 | 1.25 |

As shown in the table, after treatment of the polyester cloth with BTEAC, conductivity increased by at least a factor of from about 240 fold ($0.24\times10^{-6}/10^{-9}$). The carpet backing similarly showed an increase in conductivity of about 1200 fold over pretreatment values ($1.25\times10^{-6}/10^{-9}$).

EXAMPLE 27

This example illustrates the volume and surface resistivity of polyester fabric having a polyaniline coating treated with DF2A0.

Coatings of the polyaniline salt of dininylnaphthalene sulfonic acid were formed on pieces of polyester cloth as in Examples 21–25. The coating was dried for 10 min at 70° C. under partial vacuum of 10–20 mm Hg followed by soaking the coating and cloth in an aqueous solution of DF2A0 (17% w/w) for 10 min. The coating was then washed with water for 1 min and dried for 3 days at 70° C. under partial vacuum.

Volume and surface resistance were determined using a Kiethley model 487 Picoammeter/Voltage source and a Keithley 8009 Resistivity Test Fixture according to the manufacturer's instructions. Surface resistivity was from $9.6\times10^{6}$ to $1.6\times10^{9}\Omega$ and volume resistivity was from $7.6\times10^{6}$ to $2.9\times10^{7}\Omega$ cm. The uncoated fabric showed a surface resistivity of $3.9\times10^{14}\Omega$ and a volume resistivity of $2.3\times10^{10}\Omega$ cm.

In view of the above, it will be seen that the several advantages of the invention are achieved and other advantageous results attained.

As various changes could be made in the above methods and compositions without departing from the scope of the invention, it is intended that all matter contained in the above description and shown in the accompanying drawings shall be interpreted as illustrative and not in a limiting sense.

What is claimed is:

1. A method for increasing the conductivity of a polyaniline salt composition, the method comprising:

(a) selecting a composition comprising a polyaniline salt of an organic acid, said polyaniline salt having a conductivity and having a solubility in xylene of at least about 25% w/w; and (b) contacting said polyaniline salt with an ionic surfactant thereby to at least about double the conductivity of the polyaniline salt.

2. A method according to claim 1 wherein said ionic surfactant is a cationic surfactant.

3. A method according to claim 2 wherein said cationic surfactant is a quaternary amine compound.

4. A method according to claim 3 wherein the quaternary amine compound is benzyltriethylammonium chloride.

5. A method according to claim 4 wherein prior to the contacting said polyaniline salt has a molecular weight greater than about 4000.

6. A method according to claim 5 wherein the organic acid is dinonylnaphthalenesulfonic acid.

7. A method according to claim 6 wherein after contacting the polyaniline with benzyltriethylammonium chloride the polyaniline is soluble at a concentration of at least about 0.5% w/w in an organic solvent selected from the group consisting of chloroform, toluene, and xylenes.

8. A method according to claim 1 wherein the ionic surfactant is an anionic surfactant.

9. A method according to claim 8 wherein the anionic surfactant is a diphenyl oxide disulfonate.

10. A method according to claim 9 wherein prior to the contacting said polyaniline salt has a molecular weight greater than about 4000 and a solubility in xylene of at least about 25% w/w.

11. A method according to claim 10 wherein the organic acid is dinonylnaphthalenesulfonic acid.

12. A method according to claim 11 wherein after contacting the polyaniline with the anionic surfactant the polyaniline is soluble at a concentration of at least about 0.5% w/w in an organic solvent selected from the group consisting of chloroform, toluene, and xylenes.

13. A method according to claim 1 wherein said ionic surfactant is an amphoteric surfactant.

14. A method according to claim 13 wherein the amphoteric surfactant is 3-cyclohexylamine-1-propane sulfonic acid.

15. A method according to claim 14 wherein prior to the contacting said polyaniline salt has a molecular weight greater than about 4000 and a solubility in xylene of at least about 25%.

16. A method according to claim 15 wherein the organic acid is dinonylnaphthalenesulfonic acid.

17. A method according to claim 16 wherein after contacting the polyaniline with the amphoteric surfactant, the polyaniline is soluble at a concentration of at least about 0.5% w/w in an organic solvent selected from the group consisting of chloroform, toluene, and xylenes.

18. A method according to claim 1 wherein the composition further comprises a binder selected from the group consisting of phenolic resins, alkyd resins, aminoplast resins, vinyl alkyds, epoxy alkyds, silicone alkyds, uralkyds, epoxy resins, coal tar epoxies, urethane resins, polyurethanes, unsaturated polyester resins, silicones, vinyl acetates, vinyl acrylics, acrylic resins, phenolics, epoxy phenolics, vinyl resins, polyimides, unsaturated olefin resins, fluorinated olefin resins, cross-linkable styrenic resins, crosslinkable polyamide resins, rubber precursor, elastomer precursor, ionomers and mixtures thereof.

19. A method for increasing the conductivity of a film, coating or fiber comprised of a polyaniline salt of an organic acid, the method comprising contacting said film, coating or fiber with an ionic surfactant whereupon the conductivity of said polyaniline salt is increased by a factor of at least about 2.

* * * * *